US009517919B2

(12) United States Patent
Kalliomäki et al.

(10) Patent No.: US 9,517,919 B2
(45) Date of Patent: Dec. 13, 2016

(54) ELEVATOR WITH ADJUSTABLE BUFFER LENGTH

(71) Applicant: KONE Corporation, Helsinki (FI)

(72) Inventors: Jaakko Kalliomäki, Vantaa (FI); Mikko Puranen, Riihimäki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/716,530

(22) Filed: May 19, 2015

(65) Prior Publication Data

US 2015/0321884 A1 Nov. 12, 2015

Related U.S. Application Data

(63) Continuation of application No. PCT/EP2013/072916, filed on Nov. 4, 2013.

(30) Foreign Application Priority Data

Nov. 20, 2012 (EP) ..... 12193400

(51) Int. Cl.
*B66B 5/28* (2006.01)
*B66B 5/06* (2006.01)
*B66B 5/16* (2006.01)

(52) U.S. Cl.
CPC . *B66B 5/28* (2013.01); *B66B 5/06* (2013.01); *B66B 5/16* (2013.01); *B66B 5/282* (2013.01)

(58) Field of Classification Search
CPC ..... B66B 5/06; B66B 5/16; B66B 5/28; B66B 5/282
USPC ..... 187/247, 343, 344, 356, 357, 360, 401, 187/391
See application file for complete search history.

(56) References Cited

U.S. PATENT DOCUMENTS 4,318,456 A * 3/1982 Lowry ..... B66B 5/10 187/294
5,407,028 A * 4/1995 Jamieson ..... B66B 5/10 187/287
5,513,724 A * 5/1996 De Jong ..... B66B 5/284 187/264
5,637,841 A * 6/1997 Dugan ..... B66B 1/30 187/291
6,032,761 A * 3/2000 Coste ..... B66B 1/50 187/294
6,082,498 A * 7/2000 Coste ..... B66B 1/40 187/284
6,626,474 B1 9/2003 Ameur
7,287,626 B2 * 10/2007 Kigawa ..... B66B 5/282 187/344
7,533,763 B2 * 5/2009 Kattainen ..... B66B 1/28 187/287

(Continued)

FOREIGN PATENT DOCUMENTS

CN 101209793 A 7/2008
CN 101541659 A 9/2009

(Continued)

*Primary Examiner* — Anthony Salata
(74) *Attorney, Agent, or Firm* — Birch, Stewart, Kolasch & Birch, LLP

(57) ABSTRACT

An elevator includes at least one elevator car driving along an elevator shaft as well as an elevator control measuring the car position. The elevator further includes a buffer in the shaft pit, whose length is adjustable in response to the car position and car speed. Via this measure, the shaft pit can be reduced in high speed elevator requiring large buffer lengths.

18 Claims, 2 Drawing Sheets

Figures 1A, 1B, 1C:
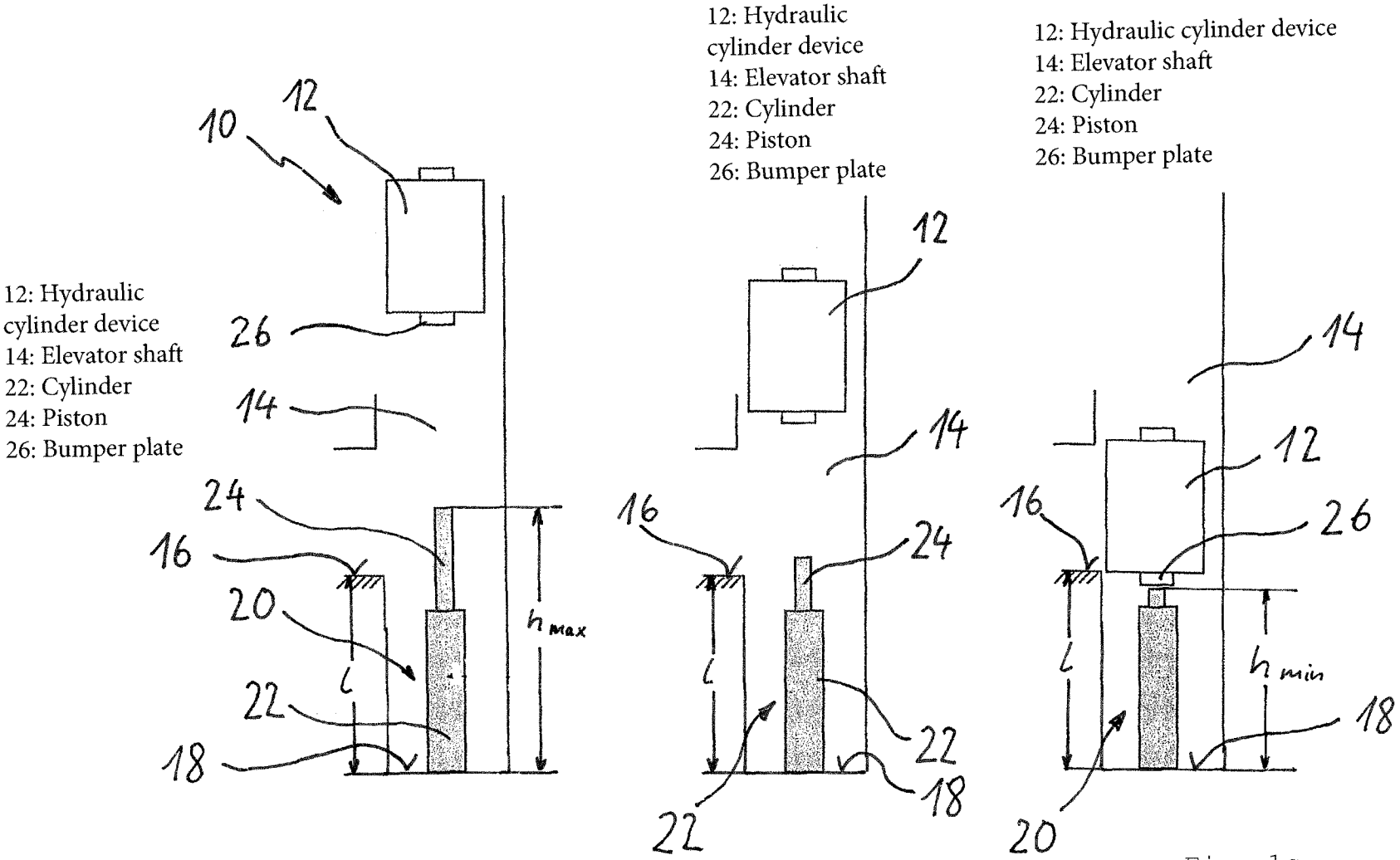

12: Hydraulic cylinder device
14: Elevator shaft
22: Cylinder
24: Piston
32: Trigger element
34, 36, 38, 40: Poststion sensor
42: Elevator control
44: Reference data memory
50: Buffer drive

(56) References Cited

U.S. PATENT DOCUMENTS

| | | | | |
|---|---|---|---|---|
| 8,371,420 | B2 * | 2/2013 | Kondo | B66B 1/32 187/288 |
| 8,408,364 | B2 * | 4/2013 | Kangas | B66B 1/3492 187/247 |
| 8,479,889 | B2 * | 7/2013 | Taavela | B66B 5/28 187/344 |
| 2011/0011681 | A1 * | 1/2011 | Kondo | B66B 1/32 187/247 |
| 2011/0132693 | A1 * | 6/2011 | Altenburger | B66B 9/00 187/240 |

FOREIGN PATENT DOCUMENTS

| | | | | |
|---|---|---|---|---|
| EP | 0 619 263 | A2 | | 10/1994 |
| EP | 2 088 111 | A1 | | 8/2009 |
| JP | 02262874 | A | * | 10/1990 |
| JP | 2004-250110 | A | | 9/2004 |
| JP | 2006-298611 | A | | 11/2006 |

* cited by examiner

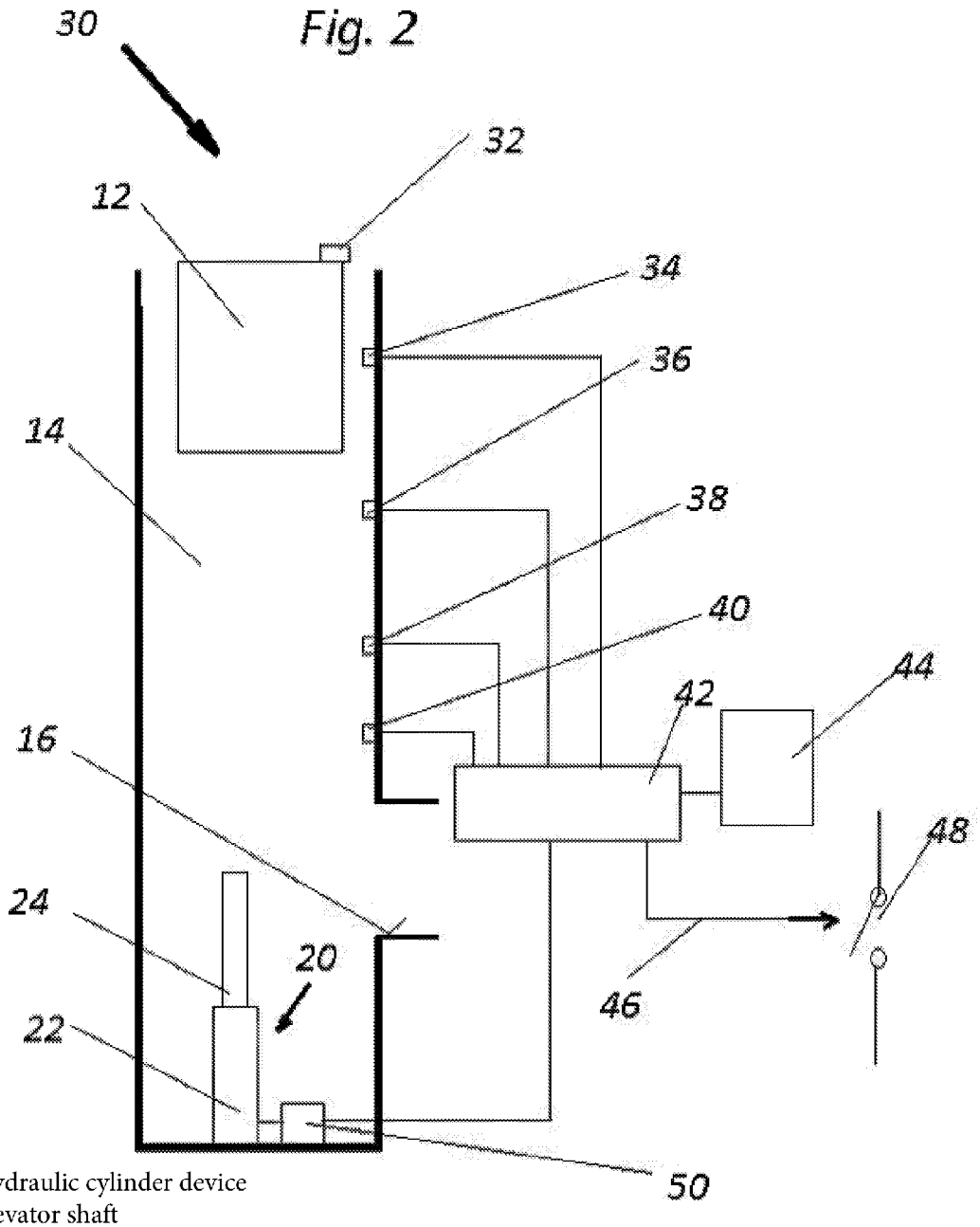
12: Hydraulic cylinder device
14: Elevator shaft
22: Cylinder
24: Piston
32: Trigger element
34, 36, 38, 40: Posistion sensor
42: Elevator control
44: Reference data memory
50: Buffer drive

ELEVATOR WITH ADJUSTABLE BUFFER LENGTH

CROSS REFERENCE TO RELATED APPLICATIONS:

This application is a Continuation of PCT International Application No. PCT/EP2013/072916, filed on Nov. 4, 2013, which claims priority under 35 U.S.C. 119(a) to Patent Application No. 12193400.4, filed in Europe on Nov. 20, 2012, all of which are hereby expressly incorporated by reference into the present application.

The invention relates to an elevator, particularly a high speed elevator with a speed preferably more than 3.5 m/s.

These high speed elevators are used in high buildings. European regulations require a buffer in the shaft pit which should dampen a collision if the elevator car should for any reasons exceed the lower limit of its drive path. According to common regulations the buffer, which produces a controlled deceleration ratio, has to have a length according to the nominal travel speed of the elevator. In case of high speed elevators regulations allow to use buffers according to lowered elevator speed, but nonetheless the required buffers are lengthy which necessitates a deep shaft pit below the lowest landing.

The EP 0 619 263 A2 discloses an elevator according to the preamble of claim 1. This elevator has a buffer with an adjustable length whereby the length adjustment is only possible when the elevator car is in its top position.

It is object of the invention to provide a high speed elevator with a reduced shaft pit depth.

The object of the invention is solved with an elevator according to claim 1 and with a method according to claim 9.

According to the invention the elevator has a buffer in the shaft pit having a length which is adjustable in response to the car position and car speed.

This solution enables the use of shaft pits with a smaller depth as the length of the buffer can be reduced during the approach of the elevator car at the lowest landing. The car position can thereby be obtained by a car position detection system of the elevator or via a separate car position detection mechanism which is provided additionally to the obligatory car position detection system of the elevator.

The invention uses the idea that the car speed is reduced when the elevator car approaches the lowest landing. In this position the car is further only some distance above the upper buffer end. Accordingly, when the car is during its down travel already in this deceleration area above the lowest landing, the buffer length can be reduced according to the decreasing travel speed in this area. When the car arrives at the lowest landing with nearly zero speed the buffer is retracted to its minimum length so that its upper end touches the car bottom or only a small clearance remains in this position between the car and the upper buffer end.

By means of the invention, the shaft pit has only has to have a length which is the minimal length of the adjustable buffer. The shaft pit can accordingly be made shorter than the buffer length required according to the nominal (or reduced according regulations) elevator car speed. As soon as the elevator car leaves the lowest landing the buffer is again driven to its extracted position where the length of the buffer corresponds to common regulations. In this position the buffer protrudes above the level of the lowest landing.

It is clear that the position detection of the car also provides information about the travel velocity so that for the reduction of the buffer length it can be ensured that the car drives downwards and has arrived the deceleration area above the lowest landing. Only if both conditions are fulfilled the buffer length shall be reduced.

To improve the safety of the solution also the car speed is used for the adjustment of the buffer length. This means that the reduction of the buffer length during the approach of the car to the lowest landing is only performed if additionally the deceleration of the car occurs as expected, e.g. corresponds to a preset deceleration slope. Accordingly, this solution ensures that the buffer length is reduced only in the case that the car decelerates in approach to the lowest landing in a normal way (e.g. according to reverence values).

In this sense, in order to realize the invention it is sufficient that the car speed is measured in the approaching stage of the lowest landing in a few points to verify that the deceleration of the car takes palace as expected. Generally it would even be possible to verify the invention with only one car speed measurement in a short distance to the lowest floor. In this position the car should have reached the slow motion phase. If the slow motion phase is confirmed by the measurement the buffer length is reduced to its lowest value. If slow motion phase is not confirmed, the buffer which most probably has already started the length reduction is immediately initiated to reach full length. This could e.g. realized with fast drives or pneumatic systems as e.g. known from air bags.

Preferably, the buffer is a hydraulic cylinder device comprising a cylinder and a piston whereby the length of the buffer can be adjusted via the stroke of the hydraulic cylinder device. For the stroke adjustment preferably a buffer drive is provided which comprises e.g. a fluid pump. Preferably oil is used as a fluid in the hydraulic buffer device.

Of course it is obligatory for the buffer to comprise a dampening element. In the specification the short term "car" stands for "elevator car".

Preferably, in the deceleration area of the elevator shaft above the lowest landing position detectors are mounted which are activated as soon as the elevator passes them. The elevator car carries a trigger element. When the trigger element passes the position detectors a buffer control part of the elevator control compares the actual car velocity with a corresponding reference value from a reference data memory connected with the elevator control. If the reference value is exceeded by a limit value a fault action is initiated. The fault action may comprise the opening of the elevator safety circuit which automatically leads to the stop of the elevator motor as well as to the operation of the machine brakes. Additionally or alternatively the buffer may be driven to its maximal length. The trigger element may be a separate element configured for the trigger action only, e.g. a magnet. It may also be a part of the elevator car, e.g. a part of the car frame.

In this context it has to be clarified that the buffer control part may be a separated or integrated part of the elevator control, e.g. a module or a program in the elevator control.

By providing several of these car position detectors at different levels in the deceleration alone above the lowest landing it can really be ensured that the given deceleration slope of the car in approach to the lowest landing is maintained.

Preferably in this case the last position detector above the lowest landing is provided immediately above the position of the trigger element, e.g. about 5 to 30 cm above the position of the trigger element when the car has entered the landing zone of the lowest landing. By this means it can be ensured that the buffer length is reduced to a minimum length as the car speed immediately above the landing stop is nearly zero.

These position detectors are preferably binary switches which are operated form one status to the other when the car passes them. As the switching status is dependent on the car velocity these switches also give information about the driving direction of the car. The binary switches may triggered by mechanical contact with a trigger element at the car. They also may consist of magneto-sensitive elements which are triggered by a magnetic trigger element mounted at the ca, preferably at the car top.

Preferably, these car position detectors are provided additionally to an obligatory car position measuring device of the elevator. This provides redundant security with respect to the actual car position as the position is determined by the obligatory car position measuring device of the elevator as well as by the car position detectors. Preferably in this case also a cross check can be performed with the car position values of the obligatory position measuring device of the elevator to verify that the measured car position values of both systems coincide. In case of missing conformity of these measured values the obligatory car position measuring device could either be readjusted to the values of the car position detectors or any mismatch action can be initiated, e.g. an automatic call to the maintenance center or the opening of the safety circuit. The above mentioned alternatives can also be taken together.

If the car speed at the levels of the different position detectors does not correspond to the given or preset deceleration slope a fault action is initiated which comprises for example the opening of the elevator circuit, in which case the drive machine is stopped and the machine brakes are operated. Another possibility which can be taken additionally or alternatively is to adjust the buffer length to its maximal value. In this case it is ensured that the car will face the maximal buffer length for any kind of collision.

Generally, it is sufficient that the buffer length is controlled only in response to the car position because when the car position is detected as to be in the deceleration zone above the lowest landing the speed of the car is already reduced to meet an obligatory deceleration slope above the lowest landing. Of course in this case an additional check is not performed to ensure that the elevator car indeed approaches with the preset deceleration slope and with correspondingly reduced speed.

In the inventive method the position of the car is determined and the length of the buffer is adjusted in response to the actual car position and actual car speed. This ensures a buffer length reduction in the deceleration zone above the lowest landing in correspondence to the gradually decreasing car speed in this zone. It is ensured that the car in fact approaches the buffer with a given reduced speed. The buffer length may be extended if the car deviates from a given deceleration slope by a limit value.

All statements made above in connection with the inventive elevator also hold true for the inventive method and vice versa.

Preferably, the minimal length of the buffer is adjusted such that the car rests on the buffer when it has arrived the lowest landing or a little clearance remains between the buffer and the car. This clearance may be e.g. ten or twenty centimeters at the maximum. By this measure the shaft pit depth can be reduced as far as possible.

The above mentioned embodiments may be combined with each other as long as this is technically feasible.

Of course, the adjustable buffer may also or alternatively be provided for the counterweight of a high speed elevator.

Furthermore, the buffer length can also be adjusted dependent on the car acceleration/deceleration, whereby the car deceleration is being evaluated as a particular form of the car speed in the sense of the present invention, i.e. the time derivation thereof. In this case e.g. the car position and the corresponding deceleration value can be compared with reference values to evaluate whether or not the buffer length will be adjusted to corresponding reduced buffer length values. The dependence of the buffer adjustment on the car speed according to the present invention also comprises the dependence on any values to which the car speed is related (any time derivations of the car position, tacho signals, values which have any mathematical relation to the car speed).

The invention is now disclosed by a means of an example in connection with the schematic drawing.

FIGS. 1*a*-1*c* show a side view of an elevator car approaching the lowest landing whereby the buffer length is reduced, and FIG. 2 shows a side view and schematic drawing of a control mechanism for verifying that the car deceleration in approach to the lowest landing is maintained.

FIG. 1 shows an elevator 10 comprising an elevator car 12 driving vertically in an elevator shaft 14 which has a lowest landing 16 and a shaft pit 18 in which a buffer 20 is extending vertically in direction of the car which buffer 20 is a hydraulic cylinder device comprising a cylinder 22 and a piston 24.

The height of the hydraulic cylinder device 20 can be adjusted between a maximal value $h_{max}$ in FIG. 1*a* and a minimum value $h_{min}$ in FIG. 1*c* which are preferably the extreme values of the stroke of the hydraulic cylinder device 20. The fluid of the hydraulic cylinder device is preferably oil. The shown elevator 10 is a high speed elevator driving with a nominal car speed $v_{max}$ of at least 3 m/s for which car speed a corresponding minimal buffer length is required, which corresponds in the embodiment and in the invention in general to the maximum length $h_{max}$ of the buffer 20.

FIGS. 1*a*-1*c* show clearly how the buffer length is reduced as the elevator car approaches the lowest landing 16. The advantage of the solution is that the depth 1 of the shaft pit can be kept lower than the required length $h_{max}$ of the buffer 20 corresponding to the nominal speed of the elevator car. This requires a shaft pit of a lower depth and achieves enormous cost savings in the building structure.

In FIG. 1 the elevator car has on its lower side a bumper plate 26 which is configured to hit the upper end of the piston 24 of the buffer 20 if the car should come into contact with the buffer 20. As FIG. 1*c* shows, only a very small clearance of maximal 10 to 20 centimeters remains between the upper end of the piston 24 and the buffer plate 26 of the elevator car 12.

When the car moves away from the lowest landing in upper direction the buffer is again driven to its maximal length $h_{max}$. The length adjustment of the hydraulic cylinder device 20 is preferably realized by a fluid pump which is controlled by the elevator control, particularly by a buffer control part thereof.

In FIG. 2 the same or functional identical parts are provided with the same reference numbers.

In the elevator 30 of FIG. 2 additionally to the components already discussed in FIG. 1 a trigger element, e.g. a magnet 32 is provided at the top of the elevator car. This trigger element 32 co-acts with four different position sensors 34, 36, 38, 40 which may for example be binary switches which are switched when the trigger element 32 passes them. The status of the switches is in this case dependent on the travel direction of the elevator car. The signal lines of these position detectors 34, 36, 38, 40 are connected with the elevator control 42 (or a buffer control part thereof) which is further connected to a reference data memory 44. Furthermore, the elevator control 42 is connected via an activation line 46 with a switch 48 of an elevator safety circuit, which is obligatory for elevators according to common regulations, as e.g. EN 81-1.

Finally, the control 42 is connected to a buffer drive 50 which is provided to adjust the length of the hydraulic cylinder device 20 comprising the cylinder 22 and the piston 24.

This embodiment works as follows:

During approach to the lowest landing the elevator car 12 decelerates. A certain distance after the beginning of the deceleration zone the trigger element 32 passes the first position detector 34. This initiates a switching signal of the first position detector 34 which is forwarded via the signal line to the elevator control 42. When the control 42 receives the switching signal of the first position detector it knows that the elevator has just passed the level of the first position detector as well as the travel direction of the car. If the travel direction is downwards it compares whether the actual car speed at the first position detector corresponds to a given car speed according to a reference speed value in the reference data memory 44. If this holds true the control 42 initiates the buffer drive 50 to reduce the buffer length according to the car speed at the level of the first position detector 34. In the further course of approach of the elevator car 12 to the lowest landing 16 the trigger element 32 further passes the second, third and fourth position detectors 36, 38, 40 whereby at each of these levels the above mentioned comparison is performed and the buffer length is reduced according to the actual car speed at the level of the position detectors (which car speed at these points is evaluated as new nominal speed for the adjustment of the buffer length). Further it is always checked whether the car speed really corresponds within given limit values to a reference data stored in the reference data memory 44. If the car approaches the lowest landing in line with a given deceleration slope the buffer length is reduced by the elevator control as shown in FIG. 1 until the car enters the lowest landing.

If for whatever reasons the actual car speed at one of the levels of the car position detectors 34, 36, 38, 40 exceeds the reference value by a limit value the control 42 opens via the activation line 46 the switch 48 in the elevator control and additionally initiates the buffer drive 50 to immediately drive the buffer 20 to its full length so that the piston 24 extends maximally from the cylinder 22.

Via these measures the safety of the system always corresponds to the buffer length which is required for the corresponding car speeds. It is further ensured that in case of deviations from normal operation sufficient safety measures are taken to avoid a crushing of the elevator car to the shaft pit.

Of course the position detector system of FIG. 2 can be applied in an elevator 10 of FIG. 1.

Of course the keeping of a preset deceleration slope in approach to the lowest landing can be checked without the position sensor system of FIG. 2 only by taking into account the car position and car speed data from the obligatory car position and car speed measuring device of the elevator.

The invention is not restricted to the shown embodiments but can be modified within the scope of the appended patent claims.

The invention claimed is:

1. An elevator comprising:

at least one elevator car driving in an elevator shaft;

an elevator control measuring the car position; and a buffer in a shaft pit of the elevator shaft, whereby a length of the buffer is adjustable in response to the car position, wherein the elevator control has a buffer control part which is configured to monitor the deceleration of the elevator car when approaching the lowest landing in the elevator shaft, and wherein the buffer control part is configured to decrease the buffer length if the car deceleration during approach to the lowest landing corresponds to a given slope.

2. The elevator according to claim 1, wherein the shaft pit has a smaller depth below the lowermost landing than a maximal length of the buffer.

3. The elevator according to claim 1, wherein the buffer is a hydraulic cylinder device having a cylinder and a piston, wherein a position of the piston with respect to the cylinder is adjustable.

4. The elevator according to claim 1, wherein control car position detectors are provided at different levels in the elevator shaft in a car deceleration zone above the lowest landing, which position detectors co-act with a triggering element mounted at the elevator car, wherein a reference data memory is provided in connection with the elevator control and wherein the buffer control part is configured to issue a fault action when actual car speed at the level of a position detector exceeds a corresponding reference speed from the reference data memory by a limit value.

5. The elevator according to claim 4, wherein the control car position detectors are provided additionally to an obligatory car position measuring device of the elevator.

6. The elevator according to claim 4, wherein the fault action comprises the opening of an elevator safety circuit.

7. The elevator according to claim 4, wherein the fault action comprises the activation of a buffer drive to extend the buffer length.

8. A method for adjusting the length of a buffer in the shaft pit of an elevator shaft, said method comprising the steps of:

determining the position of an elevator car; and adjusting the length of the buffer in response to the actual car position, wherein the buffer length is reduced when the elevator car approaches the lowest landing and decelerates according to a given deceleration slope.

9. The method according to claim 8, wherein the buffer is extended to its maximum length if the elevator car deviates by a limit extent from the given deceleration slope when approaching the lowermost landing.

10. The method according to claim 8, wherein the signal of position detectors in the car deceleration zone of the elevator shaft above the lowest landing is used as trigger for the elevator control to compare the actual car speed with a reference car speed corresponding to the location of the position detectors and wherein a fault action is provided if the actual car speed at said locations exceeds the reference value by a limit value.

11. The method according to claim 10, wherein the fault action comprises the driving of the buffer length to its maximal value and/or the opening of an elevator safety circuit.

12. The elevator according to claim 2, wherein the buffer is a hydraulic cylinder device having a cylinder and a piston, wherein a position of the piston with respect to the cylinder is adjustable.

13. The elevator according to claim 5, wherein the fault action comprises the opening of an elevator safety circuit.

14. The elevator according to claim 5, wherein the fault action comprises the activation of a buffer drive to extend the buffer length.

15. The elevator according to claim 6, wherein the fault action comprises the activation of a buffer drive to extend the buffer length.

16. The method according to claim 8, wherein the buffer is extended to its maximum length if the elevator car deviates by a limit extent from the given deceleration slope when approaching the lowermost landing.

17. The elevator according to claim 1, wherein the length of the buffer is adjustable in response to the car speed.

18. The method according to claim 8, further comprising the steps of:

determining the speed of the elevator car; and adjusting the length of the buffer in response to the actual car speed.

* * * * *